US010329699B1

(12) United States Patent
Jessie et al.

(10) Patent No.: US 10,329,699 B1
(45) Date of Patent: Jun. 25, 2019

(54) METHOD AND APPARATUS FOR MANUFACTURING AND TRANSPORTING COMPOSITE PREFORMS

(71) Applicant: A&P Technology, Inc., Cincinnati, OH (US)

(72) Inventors: Nathan Jessie, Williamsburg, OH (US); Nicholas C. Colvin, Cincinnati, OH (US); Victor M. Ivers, Amelia, OH (US); Joanna Wilson, Newport, KY (US); Lucas Rice, Loveland, OH (US); Lucas Domet, Cincinnati, OH (US); Alexandra Ivers, Amelia, OH (US); Samuel P. Ivers, Amelia, OH (US)

(73) Assignee: A & P TECHNOLOGY, INC., Cinncinnati, OH (US)

( * ) Notice: Subject to any disclaimer, the term of this patent is extended or adjusted under 35 U.S.C. 154(b) by 561 days.

(21) Appl. No.: 14/851,706

(22) Filed: Sep. 11, 2015

Related U.S. Application Data

(60) Provisional application No. 62/049,615, filed on Sep. 12, 2014.

(51) Int. Cl.
*D04C 3/48* (2006.01)
*D04C 1/06* (2006.01)
*D04C 3/40* (2006.01)

(52) U.S. Cl.
CPC ..... *D04C 3/48* (2013.01); *D04C 1/06* (2013.01); *D04C 3/40* (2013.01)

(58) Field of Classification Search
CPC ..... D04C 3/48; A44C 5/0007; A44C 5/0084; A44C 5/0092; A44C 5/12; A44C 9/0038; A44C 9/0046
See application file for complete search history.

(56) References Cited

U.S. PATENT DOCUMENTS

| | | | | | |
|---|---|---|---|---|---|
| 3,221,514 | A * | 12/1965 | Newman | A44C 9/02 | 63/15.7 |
| 4,960,232 | A * | 10/1990 | Kienhofer | A44C 5/0092 | 224/179 |
| 7,107,789 | B1 * | 9/2006 | Bruner | A44C 5/2042 | 63/15 |
| 7,347,065 | B1 * | 3/2008 | DeGolyer | A44C 9/0046 | 63/12 |
| 7,793,576 | B2 * | 9/2010 | Head | D04C 3/36 | 87/34 |
| 8,127,653 | B2 * | 3/2012 | Giebels | D04C 3/36 | 87/34 |
| 8,210,086 | B2 * | 7/2012 | Head | D04C 3/36 | 87/34 |
| 8,769,986 | B1 * | 7/2014 | DiPietro | A44C 5/0092 | 63/3.1 |
| 2002/0129619 | A1 * | 9/2002 | Wolff | A44C 9/0038 | 63/7 |
| 2008/0229921 | A1 * | 9/2008 | Head | D04C 3/36 | 87/20 |

(Continued)

*Primary Examiner* — Shaun R Hurley
(74) *Attorney, Agent, or Firm* — Answers IP, LLC; Cheryl A. Milone

(57) ABSTRACT

A braided product ring apparatus utilizes combinations of movable ring sections and/or keystone sections to modify the braided product ring apparatus during production or to remove a braided product such as a composite preform from the braided product ring apparatus. Various methods for using the braided product ring apparatus are also set forth.

11 Claims, 12 Drawing Sheets

(56) References Cited

U.S. PATENT DOCUMENTS

| | | | | |
|---|---|---|---|---|
| 2011/0005371 | A1* | 1/2011 | Giebels | D04C 3/36 87/11 |
| 2011/0056241 | A1* | 3/2011 | Li | A44C 7/00 63/12 |
| 2012/0318019 | A1* | 12/2012 | Cho | A44C 5/0092 63/3.2 |
| 2014/0298858 | A1* | 10/2014 | Chang | A44C 5/0007 63/1.13 |
| 2015/0033795 | A1* | 2/2015 | Kim | A44C 5/0084 63/3.1 |

* cited by examiner

METHOD AND APPARATUS FOR MANUFACTURING AND TRANSPORTING COMPOSITE PREFORMS

CROSS-REFERENCE TO RELATED APPLICATIONS

This patent application claims priority to and the benefit of pending provisional patent application 62/049,615 filed on Sep. 12, 2014, which is incorporated by reference herein in its entirety.

TECHNICAL FIELD

The present subject matter relates to braided structures as well as techniques and structures for the manufacture and transport of braided structures.

BACKGROUND

While braided products exhibit outstanding material qualities in a variety of situations, they can be prone to damage or difficult to handle during various stages of manufacture and transportation. Transportation can include transport between different manufacturing phases, or post-production transfer to the site at which they will be installed to a final product or structure.

SUMMARY

In an embodiment, there is disclosed a braided product ring apparatus. The braided product ring apparatus includes two or more ring sections having two or more corresponding outer rings and two or more inner web portions corresponding to the two or more ring sections. The two or more inner web portions extend inward toward a center of the braided product ring apparatus. There is also at least one pivot mechanism movably coupling the two or more ring sections, and a keystone section movably coupled with two of the two or more ring sections. The keystone section is configured to displace inward toward the center of the braided product ring apparatus, and the two or more ring sections are configured to rotate about the at least one pivot mechanism on displacement of the keystone section. The braided product ring apparatus has a production diameter when the keystone section is not displaced inward and aligned with the two of the two or more ring sections. The braided product ring apparatus also has a removal diameter when the keystone section is displaced inward toward the center of the braided product ring apparatus. The removal diameter is smaller than the production diameter.

An alternative embodiment discloses braided product ring apparatus. The apparatus comprises two or more ring sections having two or more corresponding outer rings and two or more inner web portions corresponding to the two or more ring sections, the two or more inner web portions extending inward toward a center of the braided product ring apparatus. The apparatus further comprises two or more keystone sections movably coupled with two of the two or more ring sections. The two or more keystone sections are configured to displace inward toward the center of the braided product ring apparatus, and the two or more ring sections are configured to displace inward on displacement of the two or more keystone sections. The braided product ring apparatus has a production diameter when the two or more keystone sections are aligned with the two of the two or more ring sections, and the braided product ring apparatus has a removal diameter when the two or more keystone sections are displaced inward toward the center of the braided product ring apparatus. The removal diameter is smaller than the production diameter.

In an embodiment of a method for preparing a composite preform disclosed herein, aspects can include clamping a leader portion of a braided product used in the composite preform to a braided product ring apparatus using a clamping mechanism of the braided product ring apparatus. The braided product ring apparatus includes a collapsible ring having at least two ring sections and at least one keystone section. The method can also include braiding a composite preform including at least the braided product around at least the collapsible ring of the braided product ring apparatus.

DETAILED DESCRIPTION

Figure 1:
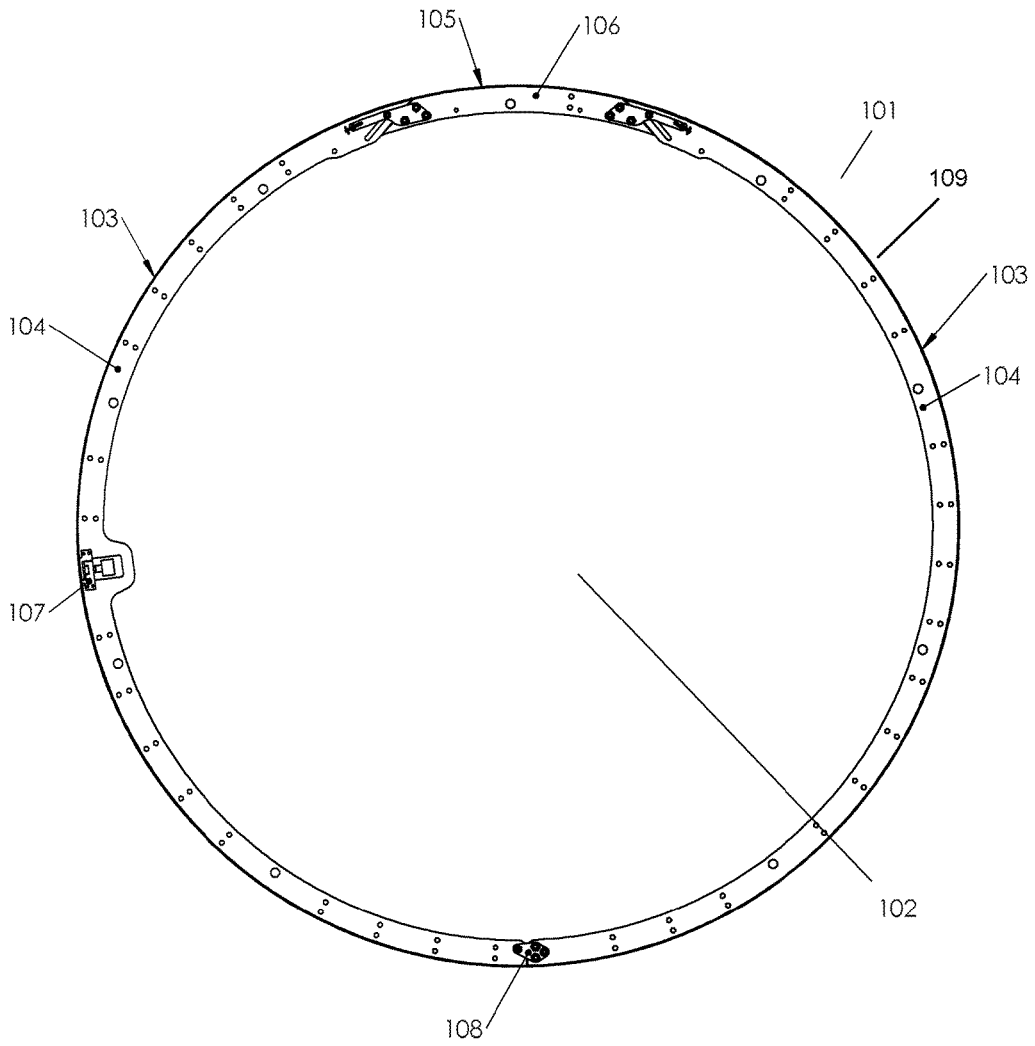
FIG. 1 illustrates an example embodiment of a braided product ring apparatus.

The innovation disclosed relates to techniques for manufacturing and transporting composite preforms including braided materials, and in embodiments can be directed toward manufacturing and transport of low-thickness, large-diameter preforms having an annular profile. The innovation in embodiments is directed toward a braided product ring apparatus which can be used as a tool during manufacture of the preform, and again as a tool during transportation of a partial or complete manufactured preform. In an example, a composite preform can be transported on the apparatus to a finishing operation during which the composite preform undergoes additional processes to render a final composite part (e.g., resin infusion, curing, et cetera).

While not exclusive to such environments, the elements and techniques disclosed herein can be utilized with, e.g., generally annular preforms having a largest principal dimension at least one order of magnitude larger than the width of the part and the maximum cross-sectional thickness of the preform is thin when compared to the largest principal direction of the part. In another example, while not exclusive to such environments, the elements and techniques disclosed herein can be utilized with, e.g., the manufacture, transport and handling of composite preforms with tight tolerances on cross-sectional thickness, width and on the dimension and geometrical relationships amongst these and the principal dimensions of the composite preform.

The elements and techniques herein rely on an apparatus which is self-contained, with which no components need be removed or separated from the apparatus to facilitate its use in all steps of the manufacturing method. Further utility is presented by the elimination for the need of any tools or other devices not already part of the apparatus for any step in the method of manufacture.

To facilitate manufacture, transport, and handling (including final installation or deployment) of the composite preform in conjunction with the apparatus, the apparatus is generally of a lightweight construction and includes features (e.g., for attaching and manipulating braided products, for removing braided products, for handling and positioning braided products and/or the apparatus, et cetera) to facilitate use of the apparatus in various contexts or environments.

Further aspects of the innovation relate to methods of manufacture, transport, and deployment of composite preforms and other braided products using the apparatus.

An example embodiment of an apparatus disclosed herein is comprised of ring sections internally supported by an inner web. The apparatus having a generally annular shape has a diameter associated with each configuration. An outer ring 109 about the circumference of the apparatus has a profile extending substantially perpendicular to the circumference. In this regard, a "corresponding" outer ring is the one that, with inner web portion 104, comprises a respective ring section 103 (or similar component). Outer ring 109 joins with an inner web portion 104 extending inward radially from outer ring 109 toward the center of the annular apparatus. The apparatus is in a rigid state during manufacture and transport of the composite preform and collapsible on deployment of the preform at a step in the manufacture for the final composite part. The inner web of the apparatus of the example embodiment may be comprised of features to mount, affix, hold, locate or otherwise determine the orientation of the apparatus during manufacture of the apparatus itself or in one or more steps of the method of manufacturing a composite preform.

An example embodiment of the composite preform manufactured using the present subject matter is a braided structure comprised of carbon fibers in a biaxial or triaxial architecture. The ring and web of the apparatus of the example embodiment can be manufactured from stainless steel, aluminum, polymers, or other rust-resistant or non-rusting materials to limit corrosion of the structure. In embodiments, the ring surface which is typically in contact with the braided structure can be polished.

Example apparatuses adapted for use with braided structures can include various components accommodating such braided materials. For example, a clamping mechanism can be employed to clamp the leading edge of the braided structure prior to wrapping layers of braid around the ring. The clamp mechanism can comprise two fixed clamp surfaces situated in the inner web of the apparatus structure wherein the clamping action is engaged by turning a knurled knob to move a movable clamp block toward at least one of the fixed surfaces. The fixed surfaces can define, in an embodiment, a gap into which the leading edge of a braided structure can be inserted. The shape of the ring and web of the apparatus of the example embodiment can be modified in the region leading into the clamp mechanism to prevent undesired radial displacement in subsequent wraps of the braid structure over the region of the clamp. By utilizing a clamp, the need is obviated for adhesive materials or other means for affixing a leading edge of a braided structure to an internal structure around which the braided structure is wrapped. The clamping mechanism can include a cutter for trimming braided materials, or a cutter can be provided elsewhere on braided product ring apparatus 101.

To remove the preform, the apparatus includes components facilitating at least partial collapsing of the ring apparatus to facilitate separation of the composite preform from the apparatus (e.g., during manufacture of the final composite part). In embodiments, this can be accomplished using various combinations of keystone mechanisms and pivot mechanisms.

The keystone mechanism of the example embodiment is an arcuate section aligning with the circumference of the ring apparatus comprised of portions of the ring and inner web wherein the keystone section can be displaced inwards, allowing the adjacent sections of the structure to collapse inwards while rotating about a pivot mechanism generally diametrically opposed to the displaced circumferential section. In embodiments, multiple keystones, and/or multiple keystones and multiple pivots, can be employed to permit collapsing in different manners or according to different diameter ratios.

An example embodiment of the method of manufacture and transport of composite preforms is comprised of the steps of preparing the apparatus for manufacture, affixing the apparatus to supporting structure on a braiding machine, starting braiding to generate a leader portion of the braided structure, inserting the leader portion into the clamp mechanism and engaging the clamp, manufacturing a predetermined number of wraps of braid on the apparatus to generate the composite preform, maintaining tension in the braided structure while the trailing portion of the braided structure is removed and during subsequent steps, removing the apparatus with the composite preform from the braiding machine, inserting the apparatus and composite preform into a box or other means of protecting the apparatus and composite preform during transport to the finishing operation for the final composite part, withdrawing the apparatus and composite preform from said means of protection and inserting the apparatus and composite preform into a finishing apparatus, disengaging the clamp and trimming the leading edge of the braided structure, engaging the means of collapse of the present apparatus to deploy the composite preform into the finishing apparatus, withdrawing the present apparatus and placing it into a box or other means of protecting the apparatus during transport back to the braiding machine.

As used herein, a final composite part is a part comprised of a textile structure and ready to be deployed in its intended application with few or no further manufacturing steps required to affect said deployment.

A final composite part may be further comprised of a resin matrix into which the textile structure is embedded.

As used herein, a composite preform is a textile structure of predetermined geometry suitable for manufacture of a specific final composite part or a limited group of final composite parts.

In final composite parts comprised of textile structures embedded within a resin matrix the composite preform generally serves as a reinforcement structure.

In final composite parts comprised of a textile structure not embedded within a resin matrix the composite preform may be considered equivalent to a final composite part.

As used herein, a braided structure is comprised of three or more strands of material, commonly called tows, such that each tow is intertwined with other tows in a repeating pattern. Two-dimensional braided materials are those wherein the repeating pattern is largely characterized by two or more principal directions in a plane, typically the longitudinal direction of the braided structure, commonly called the axial direction, and one or more oblique directions, commonly called bias directions, each at a predetermined angle to the longitudinal direction. Three-dimensional braided structures are those wherein additional principal directions, generally mutually perpendicular to the longitudinal and oblique directions, are required to completely define the structure and the patterns thereof. For simplicity of description these additional directions are generically referred to as radial directions, whether the structure is generally tubular in form, laid out as a flattened tubular form or in a fabric, or generally planar, form.

Two-dimensional braided structures may be manufactured as generally cylindrical materials, commonly called sleeves, with the axial direction corresponding to the longitudinal axis of the cylinder and the bias directions oblique to the longitudinal axis. Braided structures manufactured in cylindrical form may then be laid-flat to form a two-dimensional fabric comprised of two layers joined along the longitudinal edges. The edges may be removed to form two separate and distinct layers. One edge may be removed and the cylindrical structure laid-flat to form a singly-slit single layer structure. Two edges may be removed to form a double-slit two layer structure. Two-dimensional braided structures may further be manufactured in a single layer flat form, commonly called a tape.

In this disclosure reference to braided structure generally implies two-dimensional forms but does not exclude three-dimensional forms.

In the art, the terms "strand", "tow", "yarn", "yarn bundle", "fiber" and "fiber bundle" are generally meant to describe what is laid into or intertwined in each of the principal directions of a braided structure. In this disclosure the term "tow" will generally be used to describe what is laid into or intertwined in each of the principal directions of a braided structure. A tow is an amalgamation of all material that runs together in a principal direction. A tow can comprise monofilaments, multiple filaments or be comprised of staple, or spun, material. Tow material can have a variety of cross-sectional shapes, including but not limited to, generally circular, ellipsoidal, triangular and flat tape shapes. Tow material may be subject to intermediate or pre-processing prior to braiding operations. Examples of intermediate or pre-processing may include, but are not limited to, twisting, braiding small numbers of filaments into braided tow materials, pre-impregnation with resins and specialty coating to facilitate braiding and/or subsequent processing. A tow can comprise any combination of these materials and material forms. Any one tow may comprise one or more filament or staple materials. As non-limiting examples, a tow may be comprised of carbon materials, basalt, glass materials, thermoplastic polymeric materials, thermoset polymeric materials, a combination of carbon and polymeric materials or a combination of polymeric and glass materials, or some combination thereof. Tows that lay in one of the bias directions of the fabric are commonly called bias tows. Tows that lay in the axial direction of the fabric are commonly called axial tows.

Biaxial braid is comprised of bias tows. Triaxial braid is comprised of bias and axial tows. Hybrid braided structure are contiguous materials comprised of adjacent regions of biaxial and triaxial braid.

As used herein, a braiding machine is an apparatus for manufacture of braided structures. Said machine may be specific to a particular braid architecture or family of related braid architectures or general in that it can produce multiple braid architectures. Examples of braiding machines include maypole braiders or 3D braiders.

As used herein, a finishing apparatus is an apparatus used to situate a composite preform for further processing into a semi-finished or final composite part. Said apparatus may be used for one or more steps of manufacture of the final composite part or may be comprised of multiple apparatus each used for one or more steps of manufacture of the final composite part.

For composite preforms that may require few or no further processing steps to yield a final composite part the finishing apparatus may be an apparatus to deploy the composite preform into its intended application.

Turning to the drawings, FIG. 1 illustrates an example embodiment of the apparatus of the present subject matter. Braided product ring apparatus 101 is comprised of ring sections 103. The ring sections 103 include outer rings 109 joined to inner web portions 104. With ring sections 103, the circumference of apparatus 101 is completed by keystone section 105, which includes an outer rings 109 and keystone inner web portion 106. The complete ring apparatus 101 encircles interior space 102 which includes a center of the ring apparatus. With respect to the apparatus, the term inwards refers to any direction from outer edge of the outer rings 109 in towards the interior space 102 including the center thereof.

As illustrated in FIG. 1, the braided product ring apparatus 101 is further comprised of clamp mechanism 107 and pivot mechanism 108.

Figure 2:
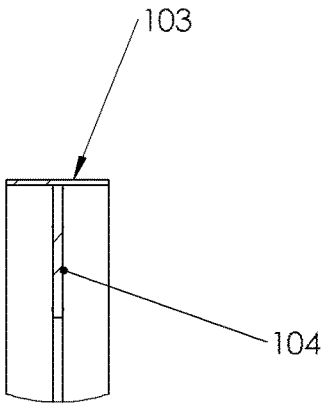
FIG. 2 illustrates an example embodiment of a cross section for a braided product ring apparatus.

FIG. 2 is a transverse cross section of the structure of the example embodiment of the apparatus. Ring section 103 is affixed to inner web portion 104 to form a "T-shaped" cross section thereby increasing the stiffness of the cross section. Keystone section 105 can similarly be coupled with keystone inner web portion 106 to form a comparably-shaped cross section.

Figure 3:
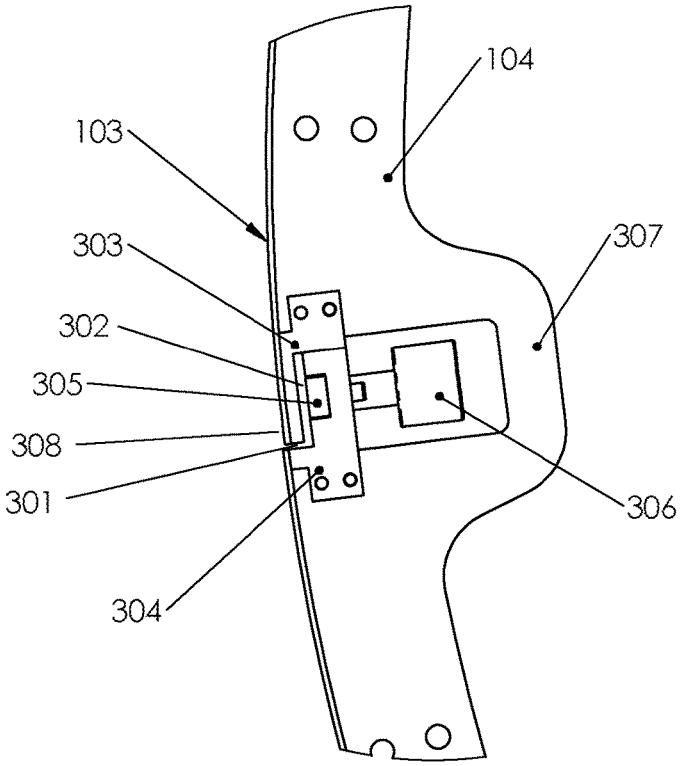
FIG. 3 illustrates an example embodiment of a clamp mechanism and corresponding inner web on a portion of a braided product ring apparatus.

FIG. 3 shows a clamp mechanism 107 of an example embodiment of braided product ring apparatus 101. At various times of apparatus 101 use, such as during manufacture of a preform, the leading portion of a braided structure can be inserted through braided product gap 301 into clamp area 302. Outer clamp block 303 and inner clamp block 304 are fixed onto inner web portion 104. Screw 306 is actuated to displace movable clamp block 305 radially outward to secure the leading edge of the braided structure against outer clamp block 303. Inner web modification 307 provides a load path for inner web portion 104 around clamp mechanism 107 to limit stresses imposed on ring sections 103 from being transmitted entirely to clamp mechanism 107. Inner web modification 307 further ensures sufficient space for mounting clamp mechanism 107 onto inner web portion 104.

In embodiments, a lead-in component 308 on inner web portion 104 allows for insertion of the leading portion of the braided structure into the clamp mechanism while preventing undesired distortion of subsequent layers of braided structure at the site of the clamp mechanism.

Figure 4:
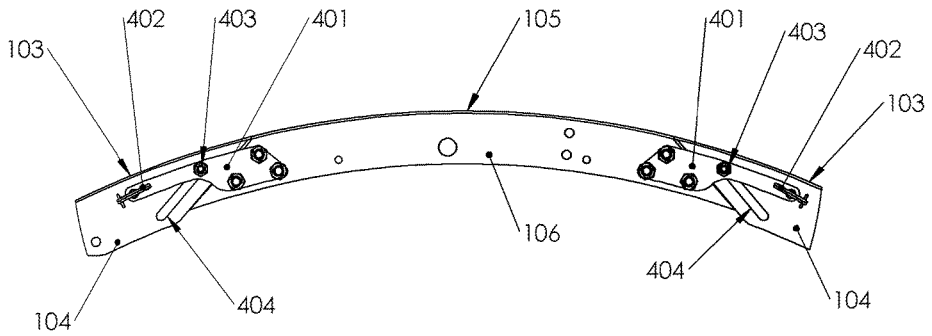
FIG. 4 illustrates an example embodiment of a keystone section and portions of adjacent ring sections in a braided product ring apparatus.

FIG. 4 shows the keystone section 105 of the example embodiment of the braided product ring apparatus. Keystone mounting plates 401 are affixed to keystone inner web portion 106. Keeper pins 402 hold keystone inner web portion 106 in place during the various manufacturing and transport steps of the method of the present subject matter.

To facilitate displacement of keystone section 105, slide pins 403 are affixed to their respective keystone mounting plates 401 and are engaged in keystone displacement slots 404 in inner web portions 104. The composite preform is released through collapsing ring apparatus 101 by pulling keeper pins 402 and displacing keystone section 105 inward. Keystone slide pins 403 slide in keystone displacement slots 404 and affect a cam action that pulls the inner web portions 104 adjacent to each end of the keystone mechanism inwards (e.g., either about a pivot or through displacement of another keystone element).

Figure 5:
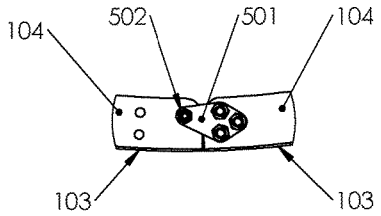
FIG. 5 illustrates an example embodiment of a pivot mechanism coupling portion of adjacent ring sections in a braided product ring apparatus.

FIG. 5 shows the pivot mechanism 108 of the example embodiment of the apparatus. Pivot mechanism allows ring sections 103 to rotate toward one another, thereby shrinking the diameter of ring apparatus 101 from a production diameter (e.g., keystone section 105 aligned with ring sections 103) to a smaller removal diameter (e.g., keystone section 105 displaced from alignment with ring sections 103), during or upon displacement of keystone section 105. Pivot plate 501 is affixed to an inner web portion 104. Pivot 502 is affixed to pivot plate 501 and allows the opposing inner web portion 104 to rotate about the axis of pivot 502 during deployment of the composite preform.

Figure 6:
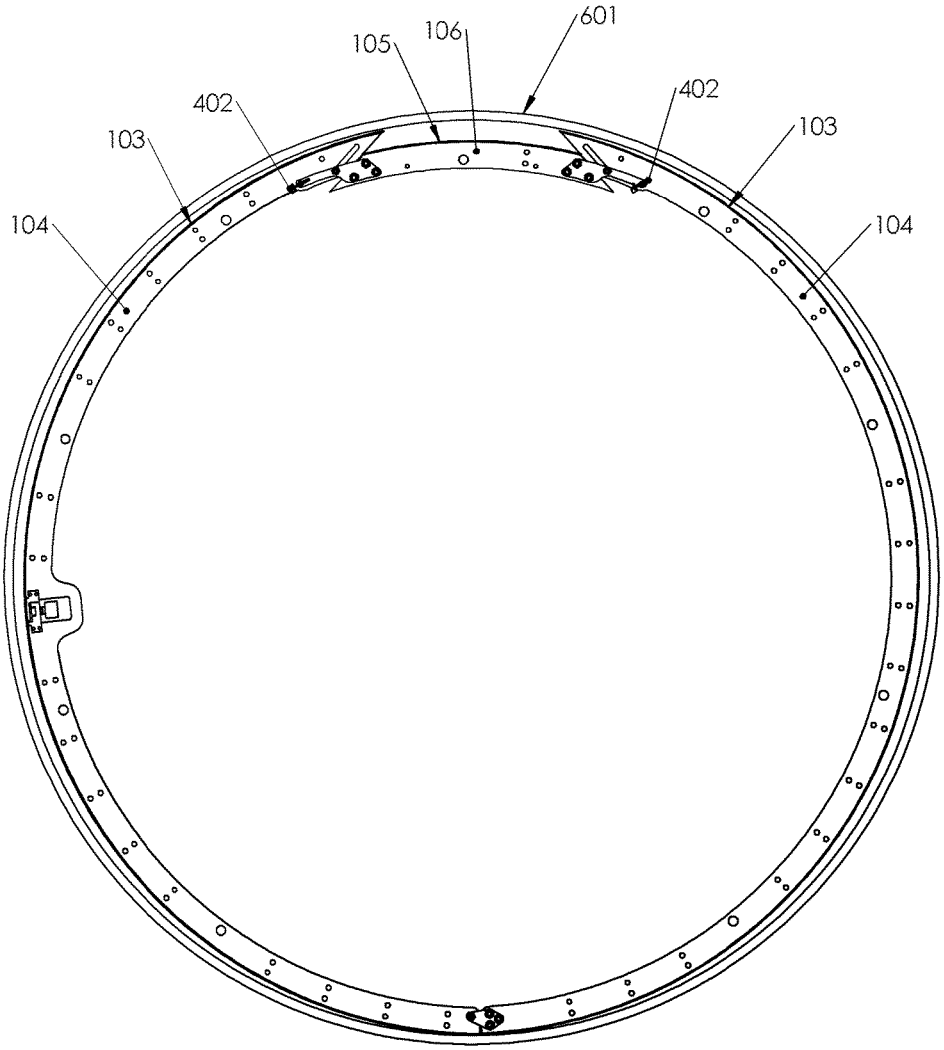
FIG. 6 illustrates an example embodiment of a braided product ring apparatus included a braided product spun there around.

FIG. 6 shows the example embodiment of the apparatus in a collapsed state for removal and/or deployment of a composite preform. In the figure, keystone section 105 is displaced inward toward the center of interior space 102. As shown, keeper pins 402 may be inserted into another hole in inner web portions 104 to hold the keystone inner web portion 106 in place during subsequent operations. Ring sections 103 and corresponding inner web portions 104 are pulled inward to separate outer ring 109 and/or other surfaces of ring sections 103 from the inner surface of composite preform 601. After adjusting ring apparatus 101 to reduce its diameter from production diameter to removal diameter, the diameter of preform 601 remains larger than the removal diameter, and extraction of ring apparatus 101 from within preform 601 avoids deformation or stressing of preform 601.

Figure 7:
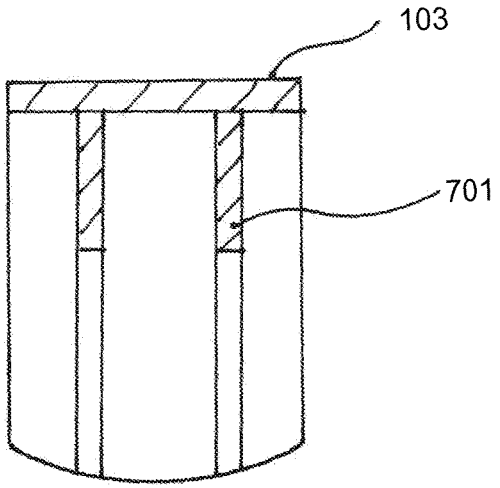
FIG. 7 illustrates an alternative example embodiment of a cross section having multiple inner web sections for a braided product ring apparatus.

FIG. 7 illustrates an alternative embodiment of the structure of braided product ring apparatus 101. In the embodiment illustrated, the portion illustrated includes at least two inner web portions 701. Ring section 103 is affixed to inner web portions 701. In such embodiments inner web portions 701 can be designed as less radially extensive than the inner web portion 104 while providing similar structural characteristics.

Figure 8:
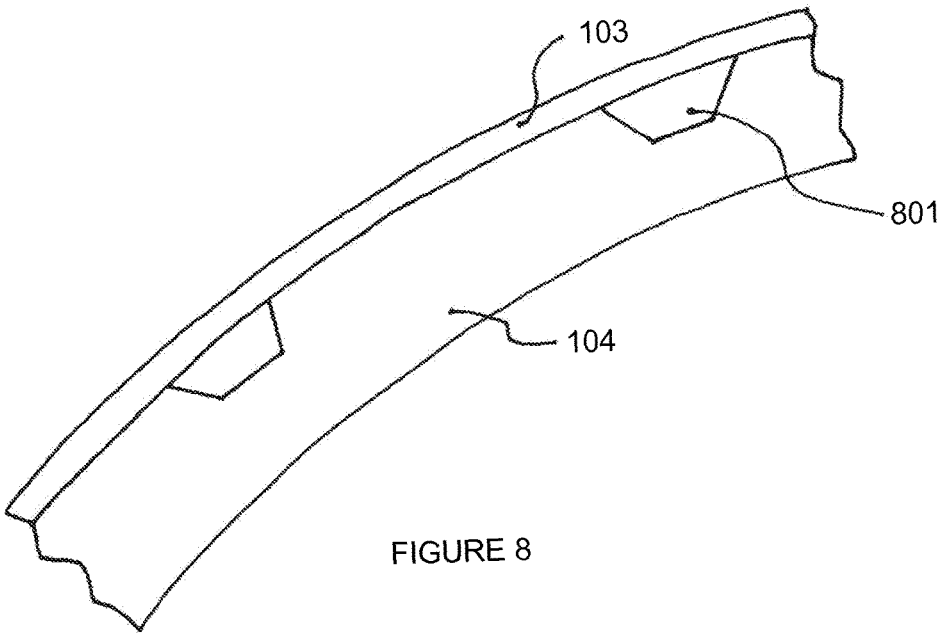
FIG. 8 illustrates an example embodiment of tabs associated with ring sections of a braided product ring apparatus.

FIG. 8 illustrates a further alternative embodiment of the structure of the apparatus 101. The embodiment of FIG. 8 includes tabs 801 which are affixed to ring sections 103 and keystone section 105. Said tabs generally have a relatively small circumferential extent. Inner web portions 104 and keystone inner web portion 106 are affixed between tabs 801 by a means that limits distortion of the structural components of the apparatus. Such means may include, but are not limited to, rivets, grommets, bolts, spot welds, plug welds, staking, drawn and flattened bosses, clips and pins.

Figure 9:
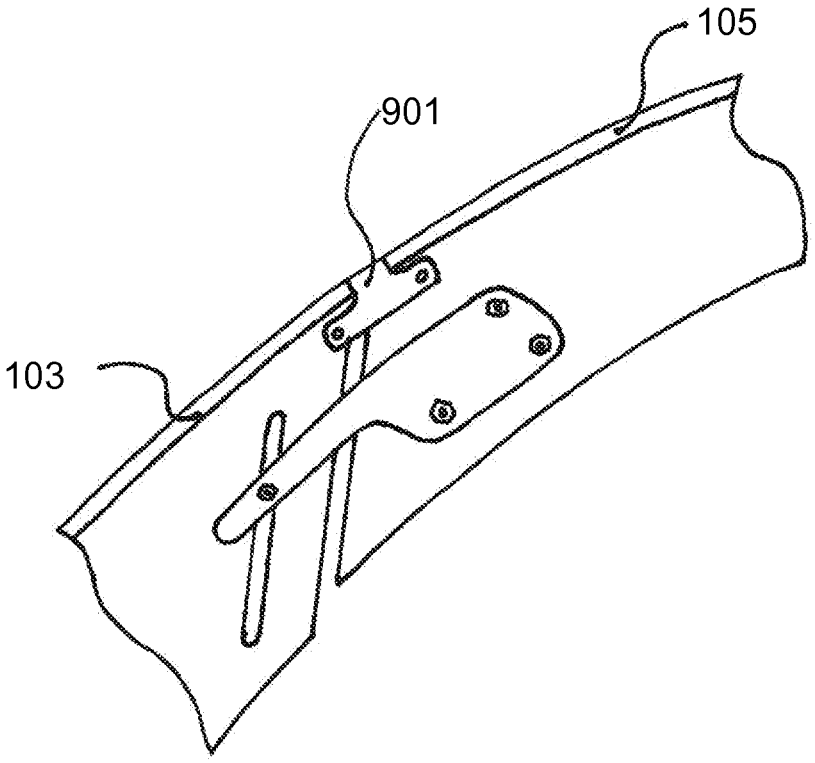
FIG. 9 illustrates an example embodiment of a braided product ring apparatus including gap filling elements between ring sections and a keystone section.

FIG. 9 illustrates another alternative embodiment of the braided product ring apparatus 101 and includes gap filling elements 901 placed in the gaps between ring sections 103 and keystone section 105, and/or in the gaps between ring sections 103 where the ring sections meet at the pivot mechanism. Said gap filling elements 901 may be comprised of, e.g., molded plastic or polymers, 3D printed parts, rubber or synthetic parts, et cetera. Alternatively, the gap filling elements 901 may also be comprised of the same materials as ring sections 103 and keystone section 105. The gap filling elements 901 may be held in position by pressure or other means of affixation to include bolts, pins, clips. Said gap filling elements 901 may be removed prior to engagement of the keystone mechanism or may remain in place throughout the method of manufacture.

Figure 10:
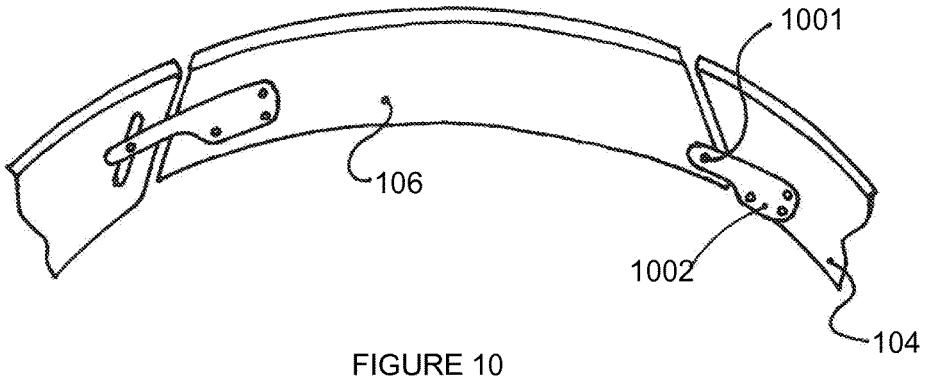
FIG. 10 illustrates an example embodiment of a braided product ring apparatus including a pivot between at least one ring sections and a keystone section.

FIG. 10 illustrates another alternative embodiment of the braided product ring apparatus 101 whereby keystone section 105 pivots about at least one axis during displacement. Specifically, as illustrated, keystone section pivots at one end around a keystone pivot mechanism 1001 the stationary portion 1002 of which is affixed to one inner web portion 104. The opposing end of keystone inner web portion 106 can be arranged to slideably displace as described in other embodiments herein.

Figure 11:
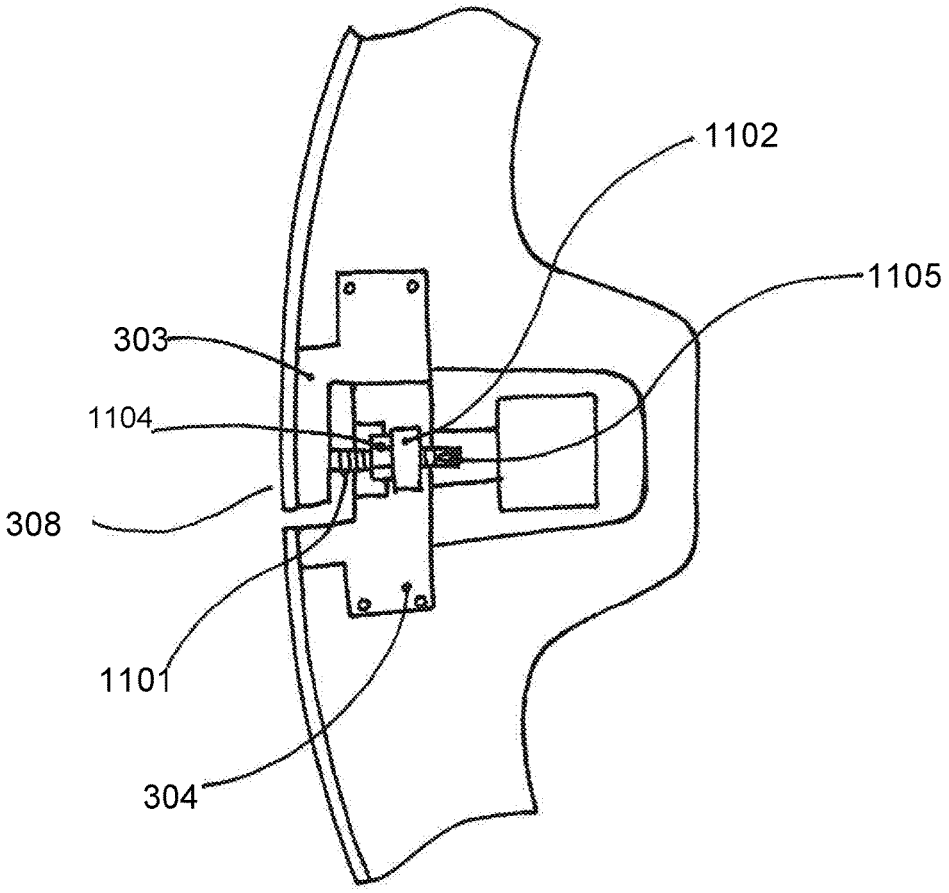
FIG. 11 illustrates an alternative example embodiment of a clamping mechanism used with a braided product ring apparatus.

FIG. 11 depicts another alternative embodiment of braided product ring apparatus 101 including threaded studs 1101 captive in outer clamp block 303. While captive, threaded studs 1101 are free to rotate relative to outer clamp block 303 at the lead-in into the clamp mechanism. Threaded studs 1101 engage pull-in blocks 1102 affixed to inner clamp block 304. A range of lead-in component 308 may be affected by backing off nuts 1104, turning threaded studs 1101 using flats 1105 and locking in the new lead-in component by tightening nuts 1104. The consequent range of lead-in component provides adjustment to further prevent distortion of layers of braid structure laid over the site of the clamp mechanism.

Figure 12:
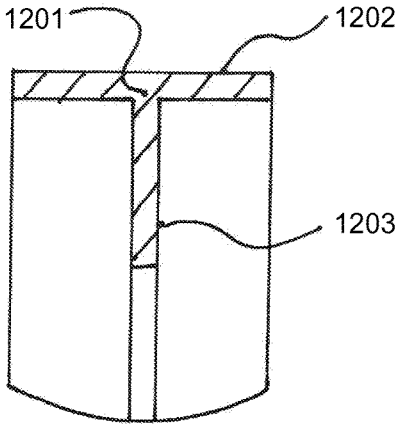
FIG. 12 illustrates an alternative example embodiment of a cross section of a portion of a braided product ring apparatus.

As shown in FIG. 12, an alternative embodiment of braided product ring apparatus 101 is comprised of a single component 1201 of similar transverse cross section to one ring section 103 affixed to inner web portion 104 (or keystone section 105 affixed to keystone inner web portion 106). Said single component 1201 is comprised of outer surface 1202 and at least one inward extending feature 1203 analogous to an inner web section. Said single component may be made of a material readily conducive to extrusion such as aluminum.

Figure 13:
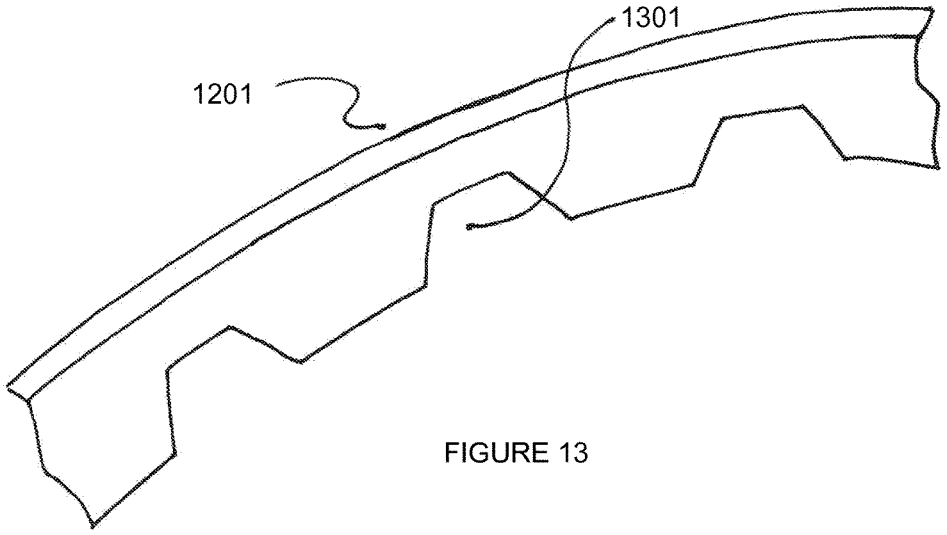
FIG. 13 illustrates an alternative example embodiment of a portion of a braided product ring apparatus.

Alternately, said single component may be made of another material, such as stainless steel and rolled. Said rolled may include relief features 1301 as shown in FIG. 13 in the inner web section to limit distortion during rolling. Alternately, the single component 1201 may be injection molded of a generally thermoplastic polymeric material or otherwise formed of a generally thermoset polymeric material.

An alternate embodiment of the apparatus of the present subject matter replaces the pivot mechanism of the example embodiment with a second keystone mechanism (or additional keystone mechanisms). These second or additional keystone mechanism(s) can be sliding, pivoting, or combinations thereof in their displacement techniques. Such multi-keystone configurations may facilitate removal of the apparatus from the composite preform for a wide variety of shapes, or for environments or contexts in which deployment is better suited using multiple keystones or ring apparatuses which collapse to different proportions. As suggested, in embodiments, additional composite preform configurations wherein at least three keystone mechanisms or wherein at least two keystone mechanism/pivot mechanism combinations are distributed through the apparatus.

Figure 14:
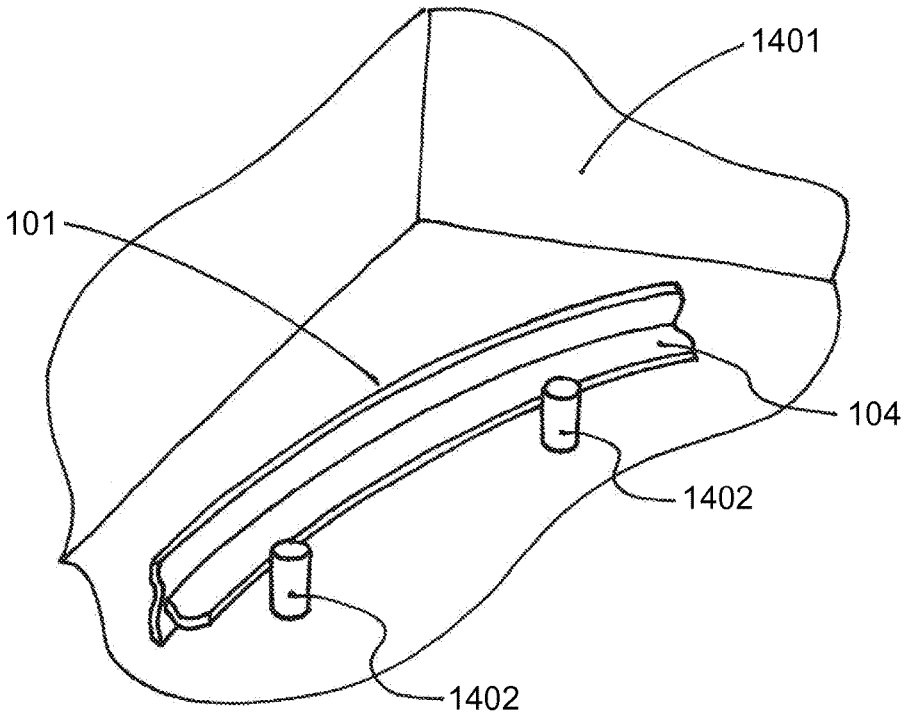
FIG. 14 illustrates an example embodiment of a portion of a braided product ring apparatus used in conjunction with locator pins for positioning.

Embodiments of systems and methods herein can further include aspects for engaging corresponding elements or arrangements in a transport function to further ensure geometrical and architectural integrity of the composite preform during movement. An example of such an embodiment in shown in FIG. 14 wherein locator pins 1402 or their equivalents within a transport apparatus 1401 engage braided product ring apparatus 101 or its alternate embodiments along the inward edge of inner web portions 104 and keystone inner web portion 106. In further alternative or complementary embodiments, transport apparatus 1401 may be comprised of a piloting boss than engages the inward edges of inner web portions 104 and keystone inner web portion 106 along their entire inward circumferences.

Figure 15:
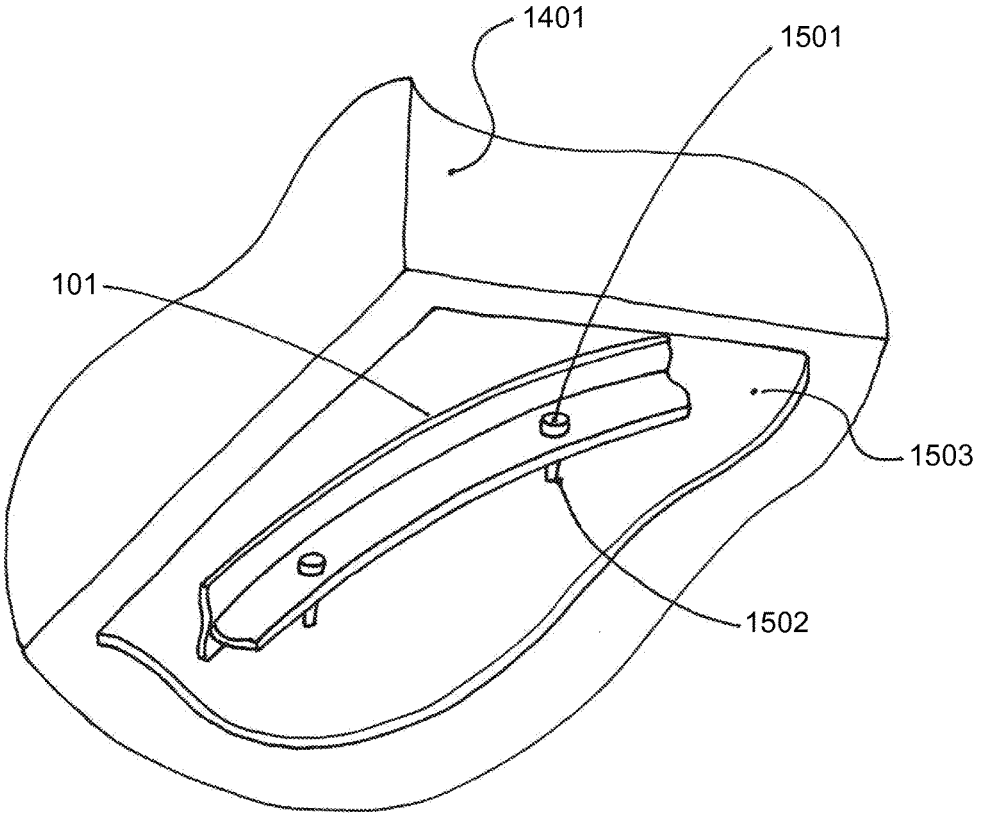
FIG. 15 illustrates an alternative example embodiment of a portion of a braided product ring apparatus used in conjunction with locator pins for positioning.

FIG. 15 illustrates a further alternative embodiment in which braided product ring apparatus 101 is held in place within transport apparatus 1401 by way of transport bolts 1501 inserted through transport holes 1502 of the inner web portions 104 and keystone inner web portion 106. Transport apparatus 1401 can further include mounting plate 1503 including tapped/threaded holes aligning with transport holes 1502 which receive transport bolts 1501. In alternative embodiments or complementary embodiments nuts or similar elements can be affixed to the interior of transport apparatus 1401.

Alternative or complementary embodiments of braided product ring apparatus 101 incorporate elements in, e.g., the ring sections 103, inner web portions 104, keystone section 105, and/or keystone inner web portion 106 that facilitate engagement with the end effectors of robot arm or robotic mechanisms used to handle the apparatus or the apparatus and the composite preform during one or more steps of manufacture. The keystone mechanism may be comprised of additional features to facilitate automated or robotic action of the collapsing function.

Alternative or complementary embodiments of braided product ring apparatus 101 can incorporate aspects in the ring sections, inner web portions and/ or their corresponding elements within the keystone mechanism that facilitate engagement of a tool deployed within interior space 102 to ensure geometrical and/or architectural integrity of the composite preform during handling. Said tool may be fixed in geometry or may be in a collapsed state prior to engagement with the apparatus and extendable at engagement.

Herein the composite preform has been largely described as having a flat inner surface on which it engages the various apparatus described. It is understood the composite preform is not restricted exclusively to a flat inner surface but may be contoured to match the profile of the final composite part or the profile required for use in its intended application. It is also understood that while herein the composite preform has been largely described as circular it is not restricted to a circular shape but may be any geometry required to meet its intended application, whether in a final composite part or as a final composite part.

In view of the example apparatuses and elements described herein, or independent thereof, methodologies that may be implemented in accordance with the disclosed subject matter will be better appreciated with reference to the flow charts. While for purposes of simplicity of explanation, the methodologies are shown and described as a series of block steps, the claimed subject matter is not limited by the order of the block steps, as some block steps may occur in different orders and/or concurrently with other block steps from what is depicted and described herein. Moreover, not all illustrated block steps may be required to implement the methods described herein, or other steps or aspects finding support elsewhere in the specification may be invoked without being expressly illustrated.

Figure 16:
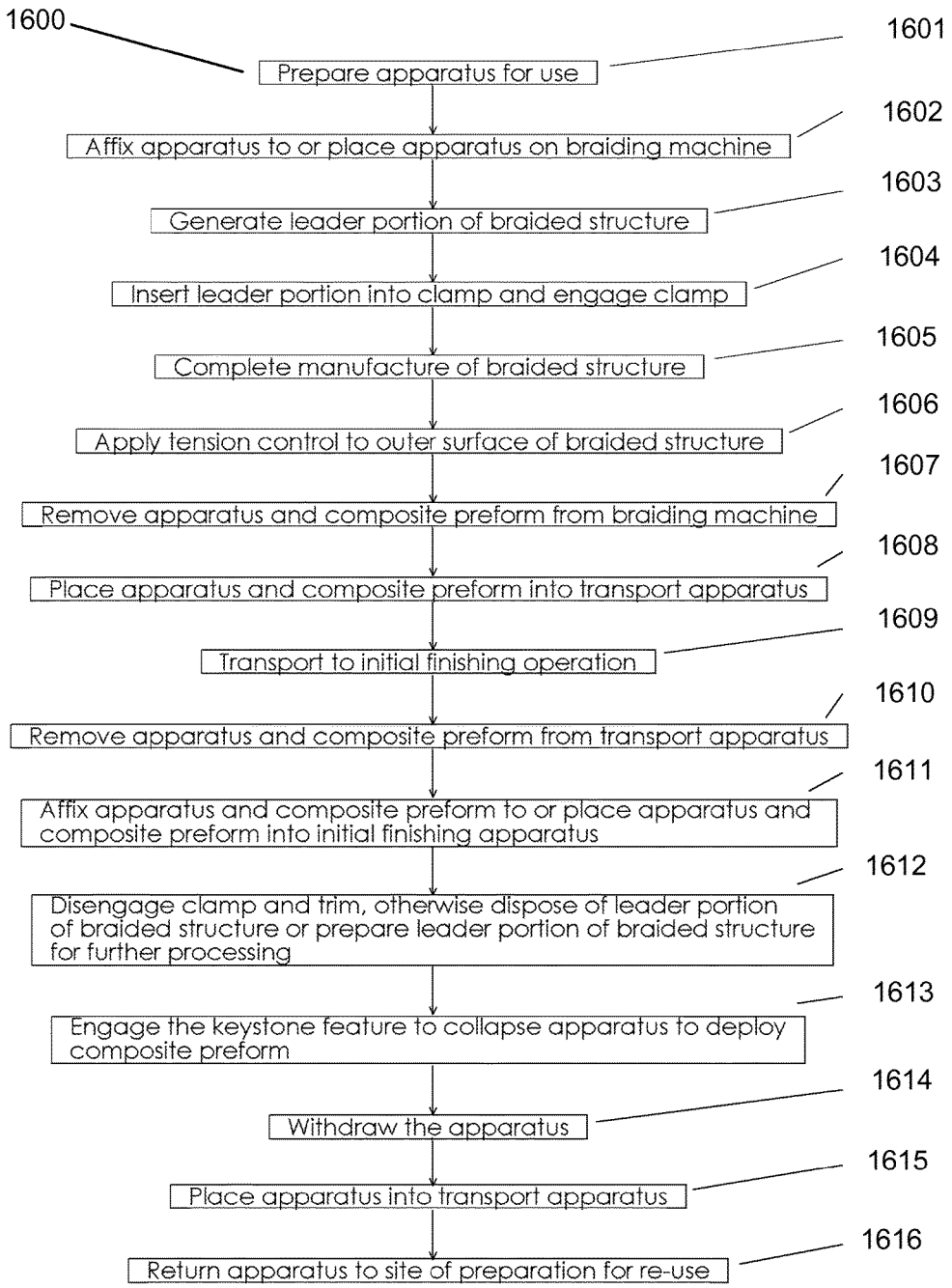
FIG. 16 illustrates an example embodiment of flow chart describing a methodology for manufacturing a braided product using a braided product ring apparatus.

FIG. 16 is a flowchart of an example embodiment for a methodology 1600 for manufacture and/or handling of braided products. Methodology 1600 begins at 1601 where a braided product ring apparatus such as those described in the embodiments above is prepared for use. Preparation may include, e.g., verification of the condition of the outer surface of ring sections, keystone section(s), and/or pivots, and/or dimensional verification of such elements and/or the geometry of the apparatus. Preparation may further include, e.g., cleaning the outer surface of ring sections and keystone section(s), resetting a keystone mechanism to an un-collapsed position (or generally resetting the apparatus to a production diameter from a removal diameter) and resetting a clamp mechanism to prepare it to accept a new leading portion of the braided structure.

Thereafter, at 1602, the apparatus is affixed to a supporting structure in a braiding machine, or the apparatus is placed into an initial position on a braiding machine. In alternative embodiments, the apparatus may be placed in proximity to a braiding machine where mounting is not required, or a braiding machine may be arranged about the apparatus. At 1603, predetermined braiding parameters can be loaded into controls of a braiding machine (or other devices/interfaces) to set the required parameters for production of the desired composite preform. The braiding machine is loaded with fiber, and the fibers are positioned to affect formation of the braided structure and the braiding machine started. The braiding operation continues at least until an appropriate leading portion of the braided structure is generated.

At 1604, the braiding machine is halted and the leader portion of the braided structure is inserted into the clamp mechanism. The clamp mechanism is engaged to fix the leader portion relative to the outer surfaces of the ring sections and the keystone section(s). At 1605, the braiding machine is started and operation continues until generation of the composite preform about the braided product ring apparatus is complete. The braiding operation may be comprised of periodic halting of braiding to perform verification functions on the composite preform or for other reasons. If necessary, the braiding parameters may be adjusted during a pause or in-stride to hold characteristics of the braided structure within required tolerances.

At 1606, the braiding operation is completed and the braiding machine halted. The tension in the braided structure can be maintained thereafter, and means of tension control can include comprised of temporarily pinning the braided structure in place, overwrapping the composite preform with plastic wrap, heating the plastic wrap to shrink it onto the composite preform, and/or other techniques.

At 1607, the apparatus and composite preform are removed from the braiding machine (if necessary). At 1608, the apparatus and composite preform are placed into a transport apparatus. The transport apparatus can protect the braided product ring apparatus and composite preform from potential damage during transport and similar handling and maintaining the geometry of the composite preform within acceptable limits. Said transport apparatus may be comprised of a skid and frame, a box (e.g., cardboard, metal, polymer, et cetera) or a rigid or semi-rigid frame (e.g., polymers, metal, wood) with or without protective cover panels.

At 1609, the apparatus and composite preform contained within the transport apparatus can be moved to an initial finishing operation (or an initial finishing operation can be otherwise started). For final composite parts wherein the composite preform is embedded in a resin matrix, said initial finishing operation can include deployment of the composite preform in a first mold component or an apparatus to facilitate vacuum bagging of the composite preform. For final composite parts wherein the composite preform largely constitutes the final composite part without a resin matrix the initial finishing operation can include a fixture to enable preparation of the composite preform for its intended application. For either composite preforms to be embedded in a resin matrix or largely used as manufactured, the initial finishing operation may constitute the only finishing operation. Alternatively, such operations may be the first of two or more finishing operations.

At 1610, the apparatus and composite preform are removed from the transport apparatus. Additional apparatus may be employed to protect the quality and integrity of the apparatus and composite preform during finishing operations. At 1611, the apparatus and composite preform are affixed to the apparatus of the initial finishing operation or are placed into the apparatus of the initial finishing operation.

At 1612, the clamp mechanism of the apparatus is disengaged. The leader portion of the braided structure disposed within the clamping mechanism may be trimmed, removed or otherwise prepared for subsequent steps of the method. At 1613, the keystone feature of the apparatus is engaged (e.g., displaced radially inward) to effect collapse of the apparatus and separation of the apparatus and composite preform. This can include displacing one or more keystone sections and/or rotating ring sections about one or more pivots.

At 1614, the apparatus is withdrawn or otherwise removed from the interior portion of the composite preform, as the composite preform maintains its diameter (a braided product diameter) equal to (or greater than) the apparatus' production diameter, and the apparatus itself is collapsed to the removal diameter. At 1615, the apparatus can be placed within the transport apparatus and prepared for transportation. In step 1616, the transport apparatus is returned to the site of the initial operation of the method of manufacture, after which the iteration of methodology 1600 ends.

While methodology 1600 includes various aspects, alternative embodiments can omit aspects illustrated, substitute aspects not described for those illustrated, or delete aspects altogether. For example, methodologies using braided product ring apparatuses need not include finishing or transport elements. Partial or alternative embodiments of methods are understood as within the scope and spirit of the innovation described in relation to the embodiments disclosed of the braided product ring apparatuses and methods using the same.

In embodiments, a braided product ring apparatus is itself an aspect of at least an initial finishing operation. For example, the apparatus may serve as a base on which a vacuum bag is disposed for vacuum resin infusion. The method associated with said alternate embodiment of the apparatus removes the steps for collapsing the apparatus and removing it from the composite preform after affixation or placement in the initial finishing operation. Said method may be comprised of a later additional step to remove the apparatus from the composite preform in a subsequent finishing operation or after the final composite part is completed or after the composite preform is deployed as a final composite part in its intended application.

Methods of manufacture as may be described herein as being constituted of separate braiding and finishing operations. It is understood that braiding and finishing may be combined operations in a single machine or other operation apparatus. Said combined operations may take place at different positions within a single machine or operation apparatus wherein the apparatus of the present subject matter serves to ensure the geometrical and architectural integrity of the composite preform as it moves from position to position. Similarly, braiding and finishing operations may take place in a single manufacturing cell comprised of multiple machines.

While the above subject matter has been illustrated and described in detail in the drawings and foregoing discussion, the same is to be considered as illustrative and not restrictive in character, it being understood that example embodiments have been shown and described and that all changes and modifications that come within the spirit of the invention are desired to be protected by the appended claims in any application claiming this application as priority and in equivalents thereof.

What is claimed is:

1. A braided product ring apparatus of comprising:

two or more ring sections;

two or more inner web portions corresponding to the two or more ring sections, the two or more inner web portions extending inward toward a center of the braided product ring apparatus;

at least one pivot mechanism movably coupling the two or more ring sections;

a keystone section movably coupled with two of the two or more ring sections, the keystone section configured to displace inward toward the center of the braided product ring apparatus;

the two or more ring sections configured to rotate about the at least one pivot mechanism on displacement of the keystone section;

a keystone section configured to transition from being aligned with the two of the two or more ring sections to being located inward of the two or more ring sections;

the braided product ring apparatus including a removal diameter when the keystone section is displaced inward toward the center of the braided product ring apparatus which is smaller than a production diameter when the keystone is aligned with the two of the two or more ring sections;

a clamping mechanism that clamps at least a leader portion of the braided product;

an outer clamp block of the clamping mechanism;

an inner clamp block of the clamping mechanism, at least the outer clamp block and the inner clamp block defining a braided product gap; and a movable clamp block of the clamping mechanism, the movable clamp block driven radially outward from the center of the braided product ring apparatus to secure the braided product against at least the outer clamp block and retracted radially inward toward the center of the braided product ring apparatus to release the braided product from the clamping mechanism.

2. A braided product ring apparatus of comprising:

two or more ring sections;

two or more inner web portions corresponding to the two or more ring sections, the two or more inner web portions extending inward toward a center of the braided product ring apparatus;

at least one pivot mechanism movably coupling the two or more ring sections;

a keystone section movably coupled with two of the two or more ring sections, the keystone section configured to displace inward toward the center of the braided product ring apparatus;

the two or more ring sections configured to rotate about the at least one pivot mechanism on displacement of the keystone section;

a keystone section configured to transition from being aligned with the two of the two or more ring sections to being located inward of the two or more ring sections;

the braided product ring apparatus including a removal diameter when the keystone section is displaced inward toward the center of the braided product ring apparatus which is smaller than a production diameter when the keystone is aligned with the two of the two or more ring sections;

a keystone inner web portion of the keystone section, the keystone inner web portion defining at least two keystone displacement slots; and at least two keystone slide pins configured to translate along the at least two keystone displacement slots to displace the keystone section inward toward the center of the braided product ring apparatus.

3. A method of preparing a composite preform, comprising:

clamping a leader portion of a braided product used in the composite preform to a braided product ring apparatus using a clamping mechanism of the braided product ring apparatus, the braided product ring apparatus including a collapsible ring having at least two ring sections and at least one keystone section; and braiding a composite preform including at least the braided product around at least the collapsible ring of the braided product ring apparatus.

4. The method of claim 3, further comprising:

displacing one or more of the at least one keystone sections of the collapsible ring toward the center of the collapsible ring; and collapsing one or more of the at least two ring sections to a removal diameter smaller than a braided product diameter.

5. The method of claim 4, further comprising removing the braided product from the apparatus.

6. The method of claim 3, further comprising aligning one or more locator pins of the apparatus with corresponding elements of a transport apparatus.

7. A braided product ring apparatus, comprising:

two or more ring sections having two or more corresponding outer rings;

two or more inner web portions corresponding to the two or more ring sections, the two or more inner web portions extending inward toward a center of the braided product ring apparatus; and two or more keystone sections movably coupled with two of the two or more ring sections, the two or more keystone sections configured to displace inward toward the center of the braided product ring apparatus, the two or more ring sections configured to displace inward on displacement of the two or more keystone sections, the braided product ring apparatus having a production diameter when the two or more keystone sections are aligned with the two of the two or more ring sections, the braided product ring apparatus having a removal diameter when the two or more keystone sections are displaced inward toward the center of the braided product ring apparatus, the removal diameter is smaller than the production diameter.

8. The braided product ring apparatus of claim 7, further comprising a clamping mechanism that clamps at least a leader portion of the braided product.

9. The braided product ring apparatus of claim 8, further comprising a lead-in component configured to receive the leader portion of the braided product without distortion of subsequent layers of braided product.

10. The braided product ring apparatus of claim 7, further comprising a gap filling element configured to fill a gap between the two or more ring sections and the two or more keystone sections.

11. The braided product ring apparatus of claim 7, further comprising a composite preform braided around at least a circumference of the braided product ring apparatus.

* * * * *